US008205637B2

(12) United States Patent
Korkmaz

(10) Patent No.: US 8,205,637 B2
(45) Date of Patent: Jun. 26, 2012

(54) FLOW-ACTUATED ACTUATOR AND METHOD

(75) Inventor: Lale Korkmaz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 576 days.

(21) Appl. No.: 12/433,134

(22) Filed: Apr. 30, 2009

(65) Prior Publication Data

US 2010/0276154 A1 Nov. 4, 2010

(51) Int. Cl.
*F16K 31/12* (2006.01)

(52) U.S. Cl. ..... 137/497; 166/332.8; 166/334.1

(58) Field of Classification Search ..... 137/494, 137/497, 504; 166/332.1, 332.8, 334.1, 374
See application file for complete search history.

(56) References Cited

U.S. PATENT DOCUMENTS

| | | | | |
|---|---|---|---|---|
| 3,151,839 | A | 10/1964 | Mott | |
| 3,973,586 | A | 8/1976 | Hill et al. | |
| 4,161,219 | A | 7/1979 | Pringle | |
| 4,215,748 | A | 8/1980 | Pace et al. | |
| 4,274,490 | A | 6/1981 | Huckaby | |
| 4,362,214 | A | 12/1982 | Pringle et al. | |
| 4,373,587 | A | 2/1983 | Pringle | |
| 4,601,342 | A | 7/1986 | Pringle | |
| 4,834,183 | A | 5/1989 | Vinzant et al. | |
| 4,838,355 | A | 6/1989 | Leismer et al. | |
| 4,856,557 | A | 8/1989 | Watson | |
| 5,004,007 | A | 4/1991 | Johnson et al. | |
| 5,040,606 | A | 8/1991 | Hopper | |
| 5,050,839 | A | 9/1991 | Dickson et al. | |
| 5,095,994 | A | 3/1992 | Dollison | |
| 5,179,973 | A | 1/1993 | Dickson et al. | |
| 5,310,005 | A | 5/1994 | Dollison | |
| 5,577,560 | A * | 11/1996 | Coronado et al. | 166/387 |
| 5,752,569 | A | 5/1998 | Bhavsar et al. | |
| 6,302,210 | B1 | 10/2001 | Crow et al. | |
| 6,394,187 | B1 | 5/2002 | Dickson et al. | |
| 6,668,935 | B1 | 12/2003 | McLoughlin et al. | |
| 6,877,564 | B2 | 4/2005 | Layton et al. | |
| 6,902,006 | B2 | 6/2005 | Myerley et al. | |
| 7,021,386 | B2 | 4/2006 | Vick, Jr. et al. | |
| 7,137,452 | B2 | 11/2006 | McVicker | |
| 7,210,498 | B2 | 5/2007 | Arigoni | |
| 7,213,653 | B2 | 5/2007 | Vick, Jr. | |
| 7,246,668 | B2 | 7/2007 | Smith | |
| 7,270,191 | B2 | 9/2007 | Drummond et al. | |
| 7,347,270 | B2 | 3/2008 | McMillan et al. | |

(Continued)

OTHER PUBLICATIONS

Notification of Transmittal of the International Search Report and the Written Opinion of the International Searching Authority; PCT/US2010/032984; International Searching Authority KIPO; Mailed Jan. 4, 2011.

Pierce, P. E., et al., "Flow Closing Coefficients from Water Flow Tests for Subsurface Controlled Safety Valves (API-SSCSV's)," Fall Meeting of the Society of Petroleum Engineers of AIME, Dallas, Texas, Sep. 28-Oct. 1, 1975, Paper No. 5601-MS.

(Continued)

*Primary Examiner* — Craig Schneider
*Assistant Examiner* — Jessica Cahill
(74) *Attorney, Agent, or Firm* — Cantor Colburn LLP

(57) ABSTRACT

A flow-actuated actuator includes a plurality of rings positionable within a structure, each ring having a full bore therethrough, and a plurality of elongated members in operable communication with the plurality of rings providing orientation of each ring to at least one adjacent ring. The plurality of rings and the plurality of elongated members are configured to generate an urging force in response to fluid flow thereby.

16 Claims, 2 Drawing Sheets

U.S. PATENT DOCUMENTS

| | | | | |
|---|---|---|---|---|
| 7,363,980 | B2 | 4/2008 | Pringle | |
| 7,409,996 | B2 | 8/2008 | Myerley et al. | |
| 2001/0007284 | A1 | 7/2001 | French et al. | |
| 2002/0079103 | A1* | 6/2002 | Knowles | 166/332.1 |
| 2002/0079104 | A1* | 6/2002 | Garcia et al. | 166/373 |
| 2006/0070744 | A1 | 4/2006 | Smith | |
| 2006/0162939 | A1 | 7/2006 | Vick, Jr. et al. | |
| 2007/0137869 | A1 | 6/2007 | MacDougall et al. | |
| 2007/0295515 | A1 | 12/2007 | Veneruso et al. | |
| 2008/0164035 | A1 | 7/2008 | Bolding et al. | |
| 2008/0196898 | A1 | 8/2008 | Jasser et al. | |
| 2008/0210438 | A1 | 9/2008 | Bolding et al. | |
| 2008/0230231 | A1 | 9/2008 | Bolding et al. | |
| 2008/0245531 | A1 | 10/2008 | Noske et al. | |
| 2009/0050327 | A1 | 2/2009 | Anderson et al. | |

OTHER PUBLICATIONS

Pedigo, John, et al., "An Acoustically Controlled Down-Hole Safety Valve (SCSSSV)," SPE Annual Fall Technical Conference and Exhibition, New Orleans, Louisiana, Oct. 3-6, 1976, Paper No. 6026-MS.

Surbey, D.W., et al., "Study of Subcritical Flow Through Multiple-Orifice Valves," SPE Production Engineering, vol. 3, No. 1, Feb. 1988, Paper No. 14285-PA.

Bolding, J.L., et al., "Damaged Control Line Replacement Safety Valve System: Thru-Tubing," SPE/ICoTA Coiled Tubing & Well Intervention Conference and Exhibition, Mar. 31-Apr. 1, 2009, The Woodlands, Texas, Paper No. 121407-MS.

* cited by examiner

FLOW-ACTUATED ACTUATOR AND METHOD

BACKGROUND

Downhole system operators are always receptive to new methods and devices to permit actuation of tools located downhole within a downhole system. Increasing flow rates of fluid pumped from surface can and has been harnessed as a method to permit actuation of a number of different types of devices in the downhole environment. In such methods downhole actuators typically use reduced diameter elements that resist fluid flow resulting in actuation forces that are proportional to the flow rate. While these work well for their intended purpose, the reduced diameter elements can limit other operations simply due to diametrical patency. Commonly then such actuators are therefore generally removed from the downhole system to allow full bore access. Devices and methods that permit actuation based on flow while not incurring the drawback noted would be well received in the art.

BRIEF DESCRIPTION

Disclosed herein is a flow-actuated actuator. The actuator includes, a plurality of rings positionable within a structure, each ring having a full bore therethrough, and a plurality of elongated members in operable communication with the plurality of rings providing orientation of each ring to at least one adjacent ring, the plurality of rings and the plurality of elongated members configured to generate an urging force in response to fluid flow thereby.

Further disclosed herein is a method of actuating a tool. The method includes, positioning a plurality of rings within a structure in operable communication with a tool to be actuated, flowing fluid through the structure past the plurality of rings, urging the plurality of rings with the flowing fluid, and actuating the tool with the urging.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
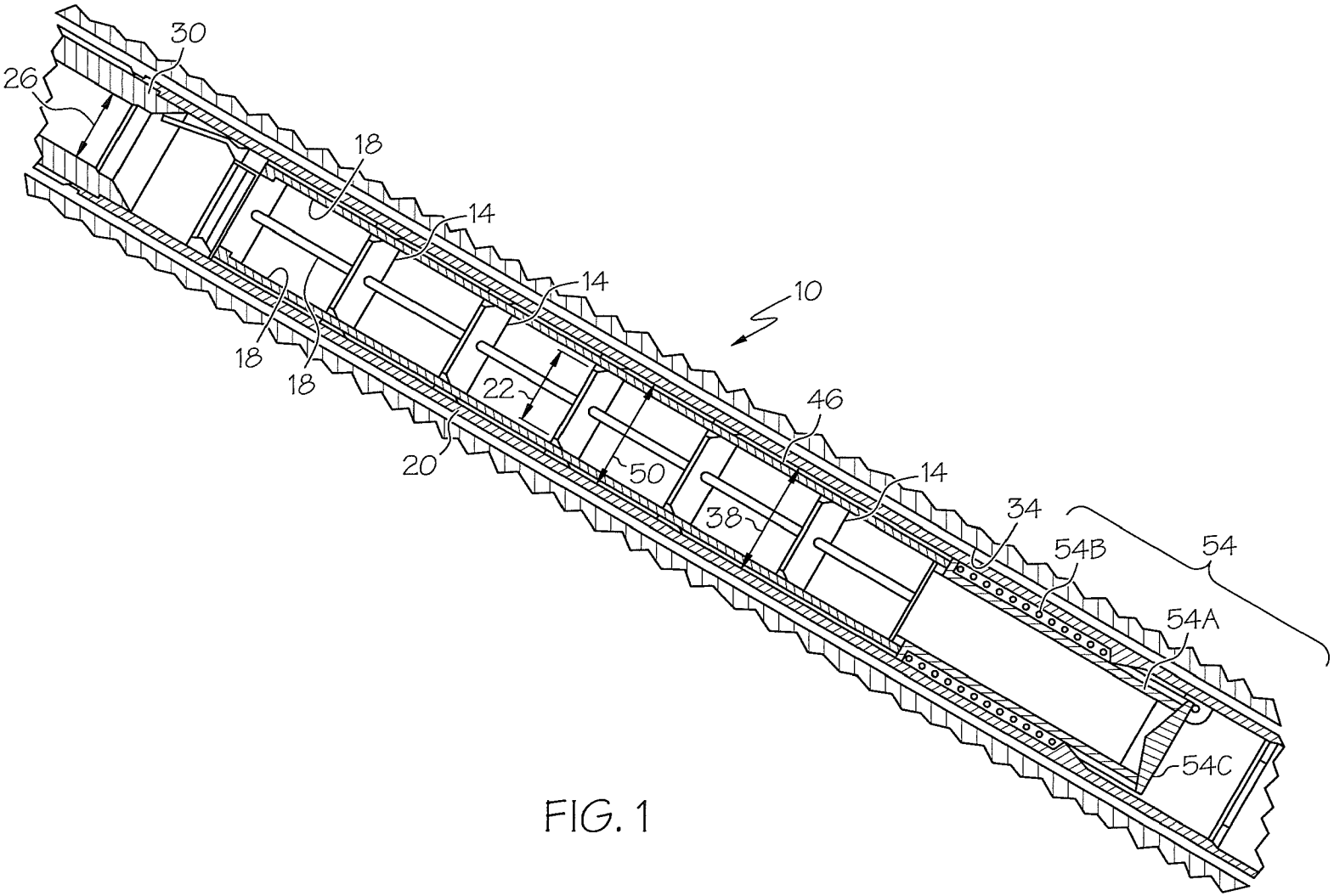
FIG. 1 depicts a cross sectional view of a flow-actuated actuator positioned within a structure.
Figure 2:
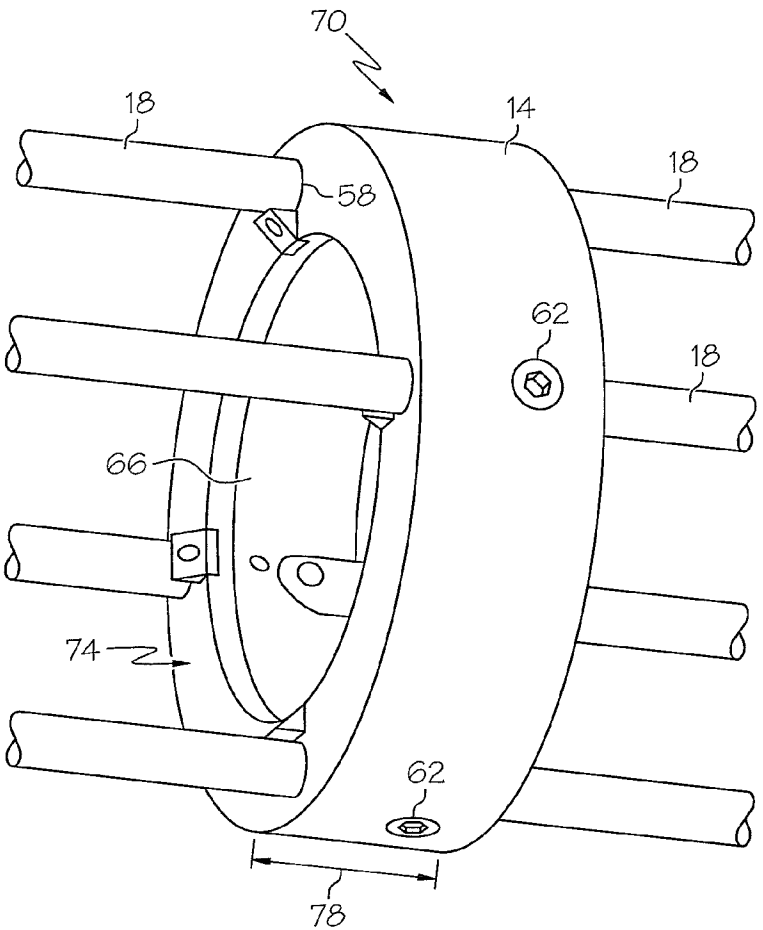
FIG. 2 depicts a partial perspective view of a portion of the flow-actuated actuator of FIG. 1.

Referring to FIGS. 1 and 2, an embodiment of a flow-actuated actuator 10 is illustrated generally at 10. The actuator 10 is a full bore actuator that does not present its own restriction to flow. Rather the actuator 10 presents an unencumbered full bore. As such, the actuator 10 creates no obstruction to full bore downhole access through the actuator 10 such as during an intervention, for example, yet provides a mechanism and method for actuating a downhole tool in response to fluid flow. Although embodiments depicted herein are in reference to downhole applications, it should be noted that the flow-actuated actuators described herein are not limited to downhole applications, and as such can be used in any application needing a flow-actuated actuator The actuator 10 includes, a plurality of rings 14, with six being shown, fixedly positioned longitudinally apart by a plurality of elongated members 18, shown herein as rods, with four rods being shown, all positioned within a structure 20, illustrated here as a tubular portion of a drillstring 30, receptive of fluid flow therethrough. The rings 14 have a full bore dimension 22 that is no smaller than a smallest inner dimension 26 of the structure 20 or drill string 30, such as at locations longitudinally beyond the actuator 10. The structure 20 and the actuator 10 are shown herein illustrated within a downhole well bore 34. The full bore dimension 22 allows access through and beyond the actuator 10 at the full bore dimension 22, thereby negating the need to remove the actuator 10 from the well bore 34 prior to such an operation.

The longitudinal separation of the rings 14 allows fluid to flow between adjacent rings 14 up to a full inner dimension 38 of the tubular 20 within which the actuator 10 is positioned. Fluid can even flow through an annular space 46 defined by the outer dimension 50 of the rings 14 and the inner dimension 38 of the tubular 20. By allowing fluid to fill the longitudinal volume between adjacent rings 14 (minus the volume of the elongated members 18), a greater resistance to fluid flow, by the actuator 10, can be generated in comparison to a tubular shaped actuator, for example. This greater resistance to fluid flow creates a larger urging force on the actuator 10 which in turn can impart a greater actuation force on a downhole tool 54, such as the illustrated flow tube 54A, biasing member 54B and flapper 54C, for example, in this embodiment. Additionally, the rings 14 and rods 18 configuration of the actuator 10 create less frictional engagement with a wellbore 34 in comparison to a tubular shaped actuator thereby lessening losses in actuation force due to friction.

Referring to FIG. 2, a magnified perspective view of a portion of the actuator 10 is illustrated. In this embodiment, longitudinal holes 58, equally spaced perimetrically about the ring 14 and extend through the ring 14, allow the rods 18 to pass therethrough. Setscrews 62 threadably engaged with the ring 14 are tightened to longitudinally fix the ring 14 to the rods 18 through frictional engagement at selected locations along the rods 18, while other attachment methods such as, welding, brazing, adhesive bonding, press fitting and threadable engagement are contemplated. Some of these attachment methods contemplated, such as the use of the setscrews 62, for example, can additionally act as a centralizer. The foregoing structure allows an operator to fixedly attach each of the rings 14 at a specific location along the rods 18. For example, each of the rings 14 may be positioned a same dimension from each of the adjacent rings 14, as shown in FIG. 1, or they may be set at differing dimensions from each of the adjacent rings 14. The spacing can be established for each particular application depending upon desired characteristics of actuation force in relation to flow.

Additionally, the rings 14 may include geometric details that influence the relationship between fluid flow and the resulting urging forces acting thereon. For example, tapering a surface 66 on a downstream end 70 of the rings 14 as defined by a direction of fluid flow (the surface 66 being on an inner radial side, as shown, or an outer radial side), or altering an angle of a leading surface 74 relative to an axis of the actuator 10 (the angle being 90 degrees as shown), or altering an overall longitudinal length 78 of the rings 14, or altering an annular dimension from the full bore dimension 22 to the outer dimension 50, of the rings 14, to mention a few. Such geometric details can cause turbulence in the flow. Turbulence can increase urging forces acting upon the rings 14 by increasing local currents, such as eddy currents, for example. The rings 14 may be geometrically identical or may be unique relative to one another. Differing the rings 14 from one another may improve the urging forces over a wider flow range since the variation in the rings 14 will present a greater variation in dimensions that can create turbulence in the flow.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A flow-actuated actuator, comprising:

a plurality of rings positionable within a structure, each ring having a full bore therethrough; and a plurality of elongated members in operable communication with the plurality of rings positionally fixing each ring relative to at least one adjacent ring throughout movements thereof, the plurality of rings and the plurality of elongated members configured to generate an urging force in response to fluid flow thereby.

2. The flow-actuated actuator of claim 1, wherein the plurality of elongated members are rods.

3. The flow-actuated actuator of claim 1, wherein the plurality of elongated members are substantially equally perimetrically spaced from one another.

4. The flow-actuated actuator of claim 1, wherein the plurality of elongated members is four.

5. The flow-actuated actuator of claim 1, wherein the plurality of rings are substantially longitudinally equally spaced.

6. The flow-actuated actuator of claim 1, wherein the plurality of rings are configured to create a combined urging force from the flow that is greater than an urging force from the flow on a single one of the plurality of rings.

7. The flow-actuated actuator of claim 1, wherein at least one of the plurality of rings has a radially inwardly facing surface that is tapered.

8. The flow-actuated actuator of claim 1, wherein the position of the plurality of rings along the plurality of elongated members is adjustable.

9. The flow-actuated actuator of claim 1, wherein the plurality of rings are attached to the plurality of elongated members by at least one of welding, brazing, adhesive bonding, press fitting, threadable engagement and frictional engagement.

10. The flow-actuated actuator of claim 1, wherein the actuator is a flow tube.

11. The flow-actuated actuator of claim 1, wherein geometric features of at least some of the plurality of rings differ from geometric features on others of the plurality of rings.

12. The flow-actuated actuator of claim 1, wherein the structure has a tubular shape.

13. A method of actuating a tool, comprising:

positioning a plurality of rings fixedly attached to one another to maintain relative positions therebetween throughout movements of the plurality of rings within a structure in operable communication with a tool to be actuated;

flowing fluid through the structure past a full bore defined by the plurality of rings;

urging the plurality of rings with the flowing fluid; and actuating the tool with the urging.

14. The method of actuating the tool of claim 13, further comprising positioning the rings a selected longitudinal dimension from one another.

15. The method of actuating the tool of claim 13, further comprising fixing the longitudinal separation of the rings with elongated members.

16. The method of actuating the tool of claim 15, wherein the fixing the longitudinal separation includes at least one selected from the group, welding, brazing, adhesive bonding, press fitting, threadably engaging and frictionally engaging.

* * * * *